US008109461B2

(12) United States Patent
Wu

(10) Patent No.: US 8,109,461 B2
(45) Date of Patent: Feb. 7, 2012

(54) FILM TRANSFER DEVICE WITH SLIDABLE PROTECTION CAP

(75) Inventor: Chien-Lung Wu, Chang Hua (TW)

(73) Assignee: SDI Corporation, Chang Hua (TW)

( * ) Notice: Subject to any disclaimer, the term of this patent is extended or adjusted under 35 U.S.C. 154(b) by 140 days.

(21) Appl. No.: 12/494,454

(22) Filed: Jun. 30, 2009

(65) Prior Publication Data

US 2010/0327102 A1 Dec. 30, 2010

(51) Int. Cl.
*B65H 75/18* (2006.01)

(52) U.S. Cl. ..... 242/588.6; 242/171; 156/577

(58) Field of Classification Search ..... 242/588, 242/588.2, 588.3, 588.6, 170, 171; 156/523, 156/527, 538, 540, 574, 577, 579, 238; 118/76, 118/200, 257

See application file for complete search history.

(56) References Cited

U.S. PATENT DOCUMENTS

| | | | | |
|---|---|---|---|---|
| 4,826,339 | A * | 5/1989 | Sasaki | 401/269 |
| 5,679,156 | A * | 10/1997 | Matsumaru | 118/200 |
| 6,321,815 | B1 * | 11/2001 | You | 156/577 |
| 6,550,518 | B1 * | 4/2003 | Lee | 156/577 |
| D475,747 | S | 6/2003 | Ono | D19/69 |
| 6,730,186 | B2 * | 5/2004 | Takahashi | 156/238 |
| 7,654,297 | B2 * | 2/2010 | Wu | 156/577 |
| 2007/0193694 | A1 | 8/2007 | Simmelsgaard et al. | 156/579 |

OTHER PUBLICATIONS

Japanese Patent Publication No. JP10-119488 A, May. 12, 1998, 3 pages.

Japanese Patent Publication No. JP2005-001850 A, Jan. 6, 2005, 8 pages.

* cited by examiner

*Primary Examiner* — William A Rivera

(74) *Attorney, Agent, or Firm* — Alan Kamrath; Kamrath IP Lawfirm, PA

(57) ABSTRACT

A film transfer device with a slidable protection cap includes a case including a compartment, a receiving section connected with the compartment, and an opening section in proximity to the receiving section. A reel mechanism is disposed in the compartment. An application head assembly is retained in the receiving section and includes an application head exposed outside the opening section. A protection cap is slidably mounted in the receiving section between a first position and a second position. The application head is concealed by the protection cap when the protection cap is in the first position. The application head is exposed from the protection cap when the protection cap is in the second position.

14 Claims, 11 Drawing Sheets

FILM TRANSFER DEVICE WITH SLIDABLE PROTECTION CAP

BACKGROUND OF THE INVENTION

1. Field of the Invention

The present invention relates to a film transfer device and, in particular, to a film transfer device including a slidable protection cap mounted thereon.

2. Description of the Related Art

U.S. Pat. No. D475,747 entitled "FILM-TRANSFER-RING DEVICE FOR OFFICE USE" shows a casing of the film transferring device including a cap hinged on a bottom side thereof to selectively fix with an application head which transfers film. Therefore, the cap is fixed with the application head to close the application head, and the cap is retained on the bottom of the casing as the application head transfers film.

The design of the above patent suffers from a problem that the cap wears the application head after repeated engagement and disengagement therebetween. Consequently, the cap is not able to be securely fixed with the application head and the cap can not protect the application head. Another problem is that the cap has a section subject to fracture due to repeated bending. As a result, the cap can not protect the application head, and the fracture has an adverse effect on appearance.

The present invention is, therefore, intended to obviate or at least alleviate the problems encountered in the prior art by providing a film transfer device with a slidable protection cap which is durable and convenient for use.

SUMMARY OF THE INVENTION

According to the present invention, a film transfer device with a slidable protection cap includes a case including a compartment, a receiving section connected with the compartment, and an opening section in proximity to the receiving section. A reel mechanism is disposed in the compartment. An application head assembly is retained in the receiving section and includes an application head exposed outside the opening section. A protection cap is slidably mounted in the receiving section between a first position and a second position. The application head is concealed by the protection cap when the protection cap is in the first position. The application head is exposed from the protection cap when the protection cap is in the second position.

It is an object of the present invention that the protection cap is disposed in the case and is moveable between two positions to selectively conceal or expose the application head. Thus, the application head is protected from dust and dirt by the protection cap.

It is another object of the present invention that the protection cap exposes the application head when the protection cap is in the second position. Additionally, the protection cap has position-limiting grooves which engage with protruding sections of the application head assembly to prevent the protection cap from shaking movement, which adversely influences film-dispensing operation.

It is a further object of the present invention that the application head assembly includes a fixing frame retained in the case and prevented from being displaced. Thus, the steadiness of the fixing frame is ensured, and the fixing frame is prevented from loosening and displacement in the case.

DETAILED DESCRIPTION OF THE PREFERRED EMBODIMENTS

While the best embodiments will be illustrated and described with reference to the drawings hereafter, numerous modifications come to mind without significantly departing from the spirit of invention, and the scope of invention is not limited by the specific embodiments.

Figure 1:
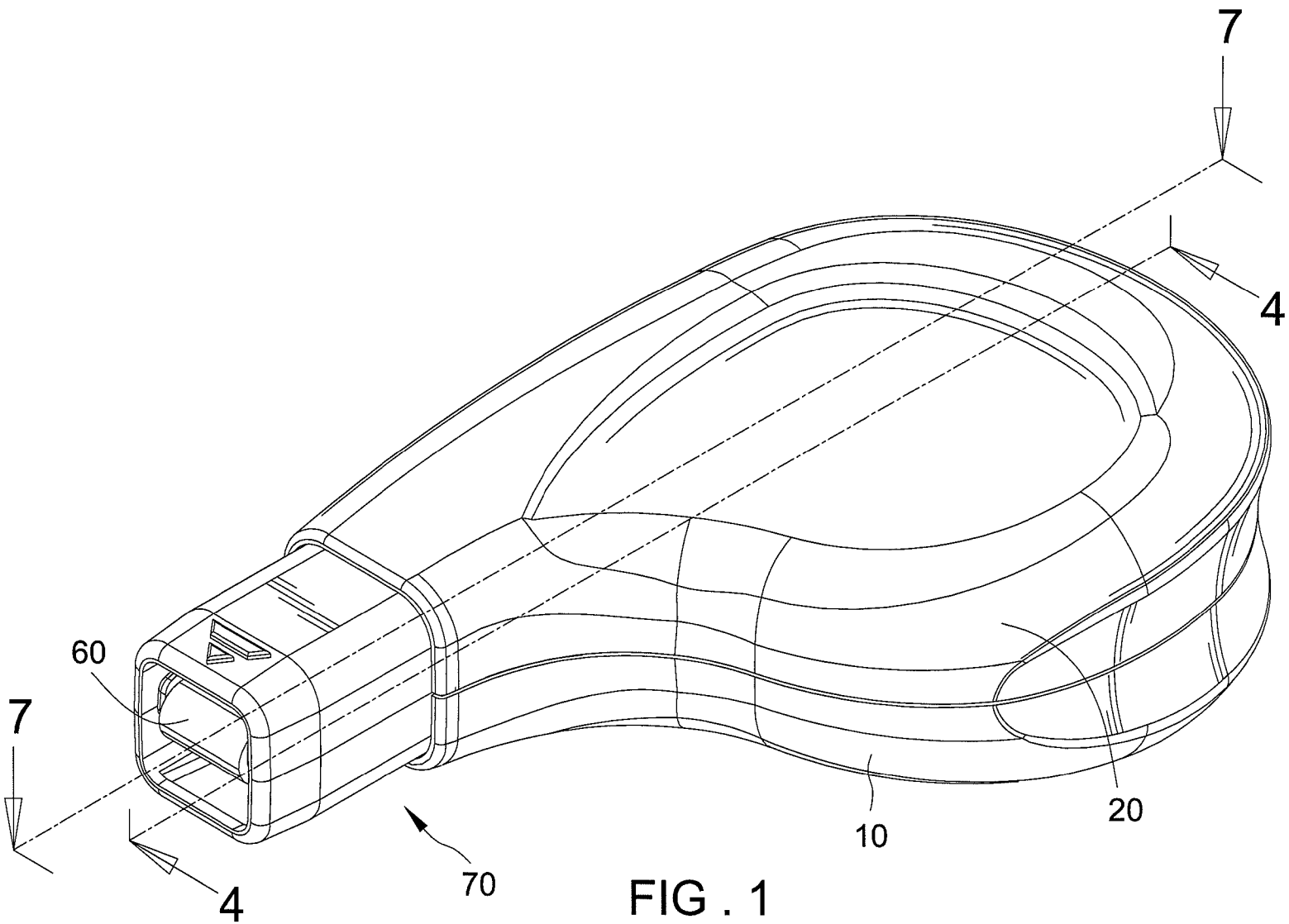
FIG. 1 is a perspective view of a film transfer device with a slidable protection cap in accordance with the present invention.
Figure 2:
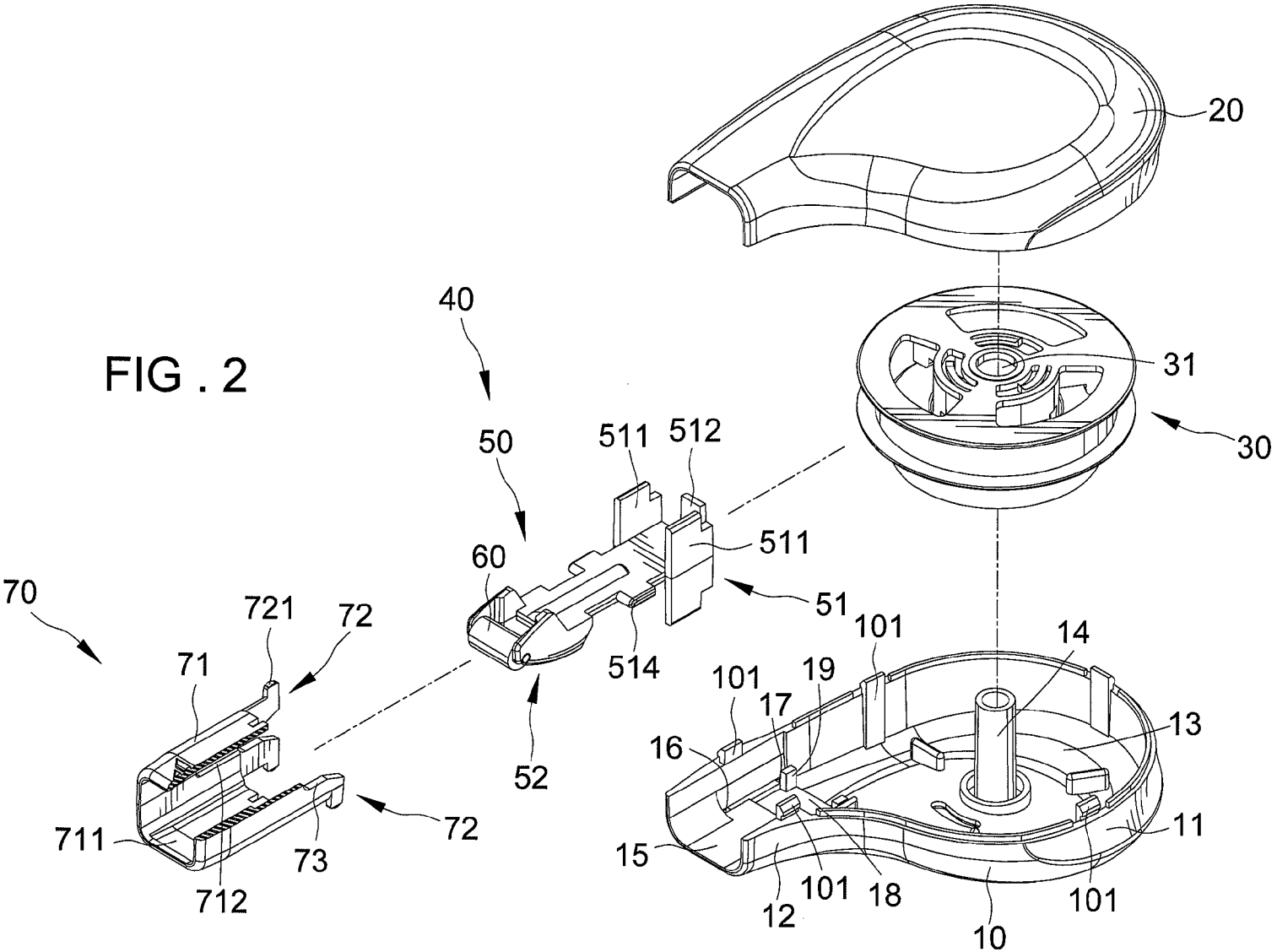
FIG. 2 is an exploded perspective view of the film transfer device shown in FIG. 1.
Figure 3:
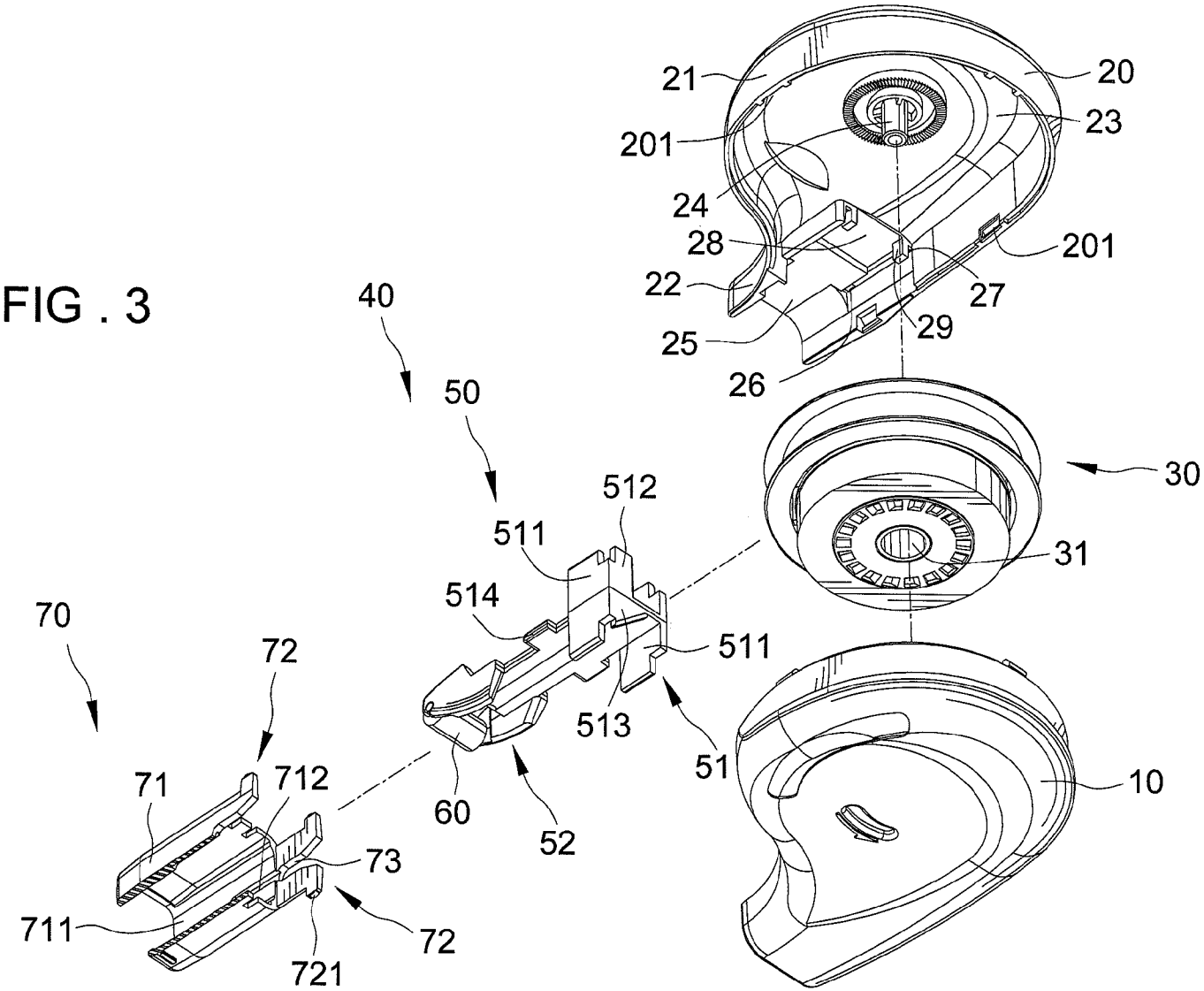
FIG. 3 is another exploded perspective view of the film transfer device taken at a different angle than that of FIG. 2.

FIGS. 1 through 3 show perspective and exploded perspective views of a film transfer device with a slidable protection cap in accordance with a first embodiment of the present invention. This embodiment includes a first case 10 and a second case 20 connected to the first case 10 and disposed opposite to the first case 10. This embodiment further includes a reel mechanism 30, an application head assembly 40 and a protection cap 70 surrounded by the first and second cases 10, 20.

The first case 10 includes a first section 11 and a second section 12, and the second case 20 includes a first section 21 and a second section 22, respectively. The first section 11 of the first case 10 forms a compartment 13 and includes a strut 14 extended from and disposed in the compartment 13. The first section 21 of the second case 20 forms a compartment 23 and includes an axle 24 extended from and disposed in the compartment 23. The reel mechanism 30 is disposed in the compartment 13 in the first case 10 and the compartment 23 in the second case 20.The reel mechanism 30 includes a through hole 31 extending in a center thereof for insertion of the strut 14 in the first case 10, and the strut 14 is thereafter engaged with the axle 24 in the second case 20.

The second section 12 of the first case 10 includes an opening section 15, and the second section 22 of the second case 20 includes an opening section 25, respectively. The second section 12 of the first case 10 also includes a first positioning section 16 and a second positioning section 17 disposed on a side of the first case 10 and in proximity to the opening section 15. The second section 22 of the second case 20 also includes a first positioning section 26, and a second positioning section 27 disposed on a side of the second case 20 and in proximity to the opening sections 25, respectively. The first positioning section 16 is disposed corresponding to the first positioning section 26, and the second positioning section 17 is disposed corresponding to the second positioning section 27. Further, a receiving section 18 is defined between the opening section 15 and the compartment 13, and, correspondingly, a receiving section 28 is defined between the opening section 25 and the compartment 23. Additionally, the receiving section 18 includes a stopping section 19 extended therefrom, and the receiving section 28 includes a stopping section 29 extended therefrom, respectively. The stopping sections 19 is disposed on an end opposite to the opening section 15, and the stopping sections 29 is disposed on an end opposite to the opening section 25, respectively. The first and second positioning sections 16 and 17 are disposed in proximity to the receiving section 18, and the first and second positioning sections 26 and 27 are disposed in proximity to the receiving section 28, respectively. Furthermore, the first case 10 includes a plurality of hooking sections 101, and the second case 20 includes a plurality of hooking sections 201 disposed corresponding to the plurality of hooking sections 101 and engaged with respective hooking sections 101 in order to fix the first and second cases 10 and 20 together. The first case 10 is disposed symmetrical to the second case 20 and the reel mechanism 30, the application head assembly 40 and the protection cap 70 are held between the first and second cases 10.

The application head assembly 40 is disposed between the first and second cases 10 and 20 and includes a fixing frame 50 and an application head 60. The fixing frame 50 includes a first end 51 retained in the receiving sections 18 and 28 of the respective first and second cases 10 and 20 and a second end 52 connected with the application head 60. The application head 60 defines a plane which divides the receiving sections 18 and 28 and is exposed outside the opening sections 15 and 25 of the respective first and second cases 10 and 20.

Referring further to FIG. 3, the fixing frame 50 is elongated and with resiliency. The first end 51 includes two lateral walls 511, and a first guiding wall 512 and a second guiding wall 513. The lateral walls 511 and the first and second guiding walls 512 and 513 extend in a direction substantially perpendicularly to a frame direction from the first end 51 to the second end 52. The first and second guiding walls 512 and 513 are disposed on an extremity of the fixing frame 50. Furthermore, the first and second guiding walls 512 and 513 are formed on two opposite sides of the fixing frame 50. Additionally, the first guiding wall 512 includes a guiding edge extending generally perpendicular to the frame direction and to the plane of the fixing frame, and the second guiding wall 513 includes a guiding edge extending at an angle which is not perpendicular or parallel to the frame direction and to the plane of the fixing frame to guide film from the reel mechanism 30 through a 90-degree rotation. The fixing frame 50 also includes two lateral sides and each lateral side includes a protruding section 514 extended therefrom and disposed in proximity to one lateral wall 511. Furthermore, the first end 51 of the fixing frame 50 is disposed in the receiving sections 18 and 28 of the respective first and second cases 10 and 20. Each lateral wall 511 has one end stopped on the stopping section 19 and another end stopped on the stopping section 29 such that the fixing frame 50 is retained between the first and second cases 10 and 20 and is prevented from displacement. Thus, the steadiness of the fixing frame 50 is ensured and the fixing frame 50 is prevented from loosening and displacement in the first and second cases 10 and 20. Furthermore, the application head 60 is pivotally mounted on the second end 52 of the fixing frame 50, and the application head 60 extends outward of the fixing frame 50 and is adapted to abut against on an item to be worked with. Because the application head 60 is made from a material which has resiliency, it is convenient to enable film to stick on a surface of the item. In this preferred embodiment, the application head 60 is configured as a roller. Additionally, the application head 60 is adapted to enable film to be apply on the surface of the item.

The protection cap 70 is insertably mounted on the application head assembly 40 and is configured of a body 71 and two clipping legs 72. The body 71 includes a channel 711 extending axially through two ends thereof. The clipping legs 72 are extended from two lateral surfaces of the body 71, respectively, and in the same direction. Each clipping leg 72 also has a through slot 73 extended axially, and the through slot 73 enables the clipping leg 72 to have bending resiliency. The body 71 further includes two position-limiting grooves 712 extended on the two lateral surfaces, respectively, and each position-limiting groove 712 is disposed corresponding to one through slot 73. The position-limiting grooves 712 receive two protruding sections 514 respectively so as to prevent the protection cap 70 from shaking movement. Each clipping leg 72 further includes an engaging section 721 extended from an end thereof and selectively positioned on the first positioning sections 16 and 26 and on the second positioning sections 17 and 27 of the respective first and second cases 10 and 20.

Figure 4:
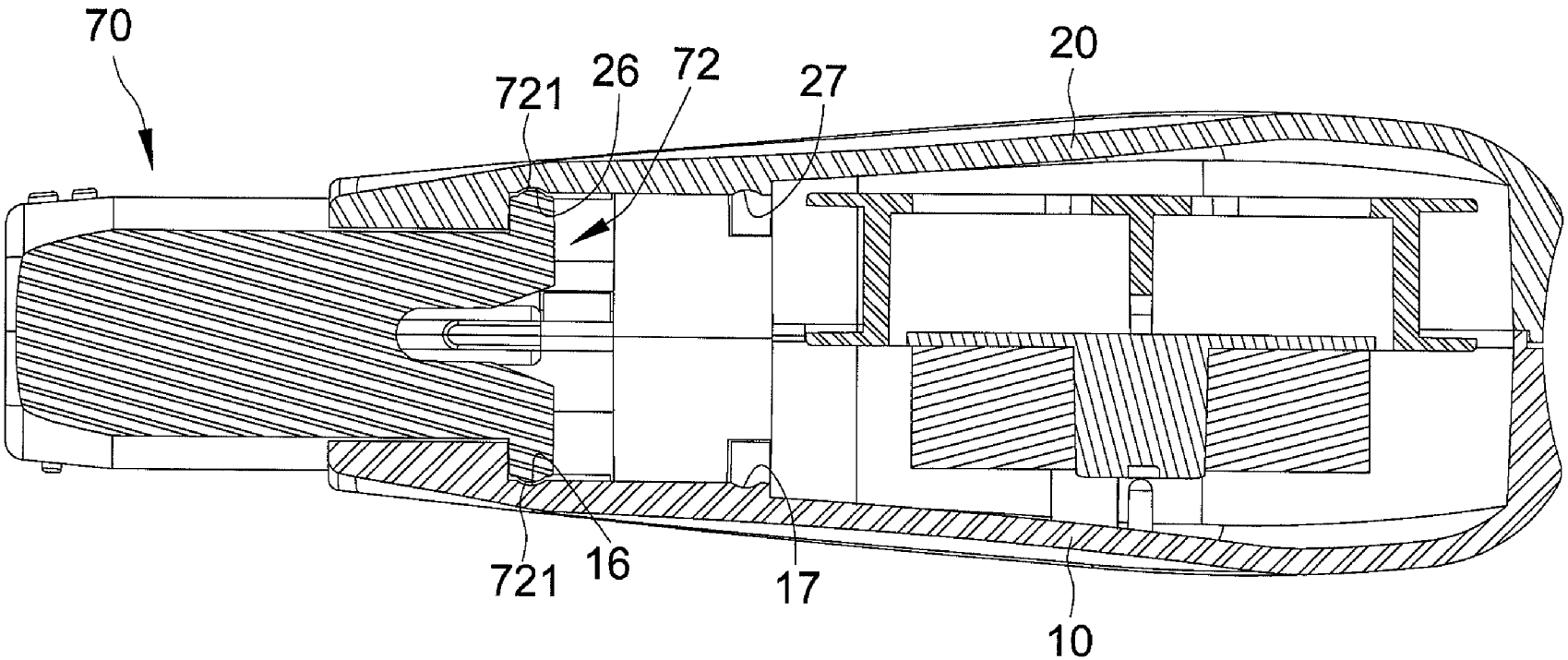
FIG. 4 is a cross-sectional view taken along line 4-4 of FIG. 1.
Figure 5:
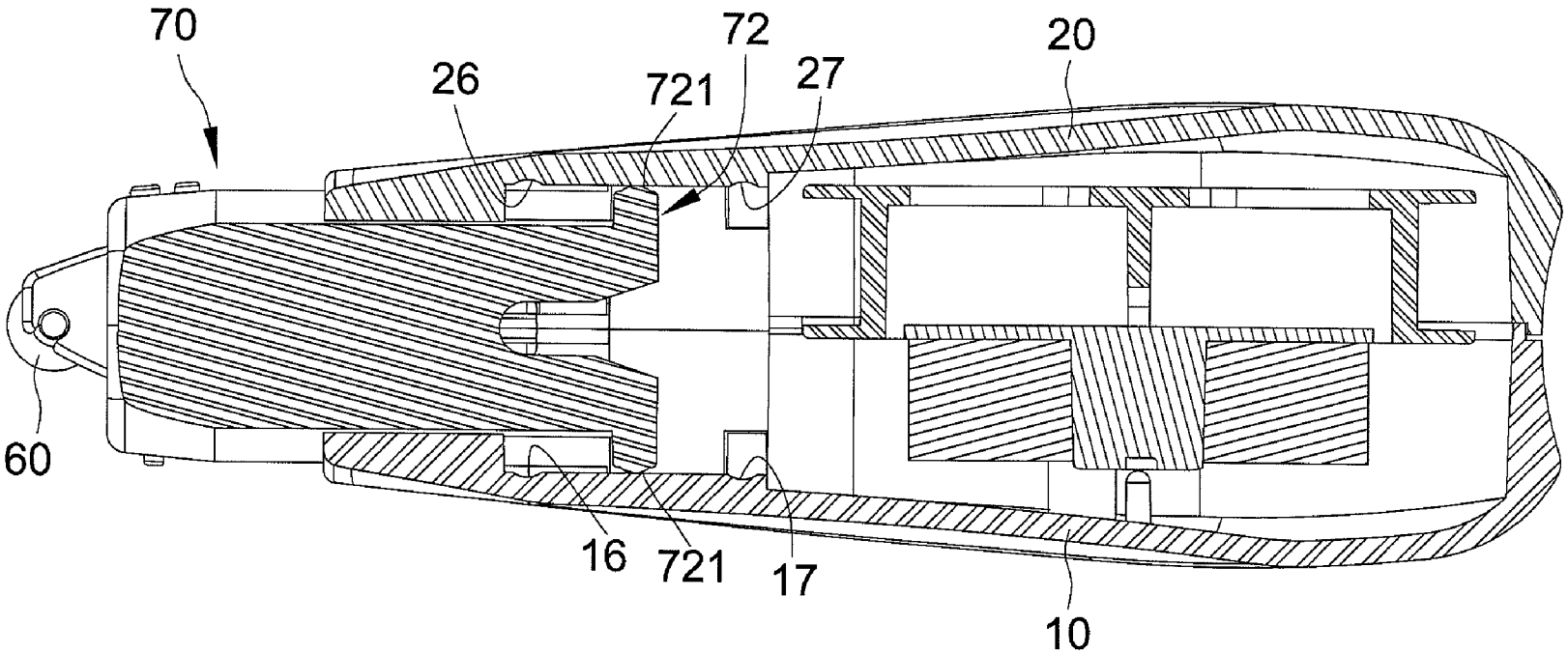
FIG. 5 is a cross-sectional view showing a position of the protection cap.
Figure 6:
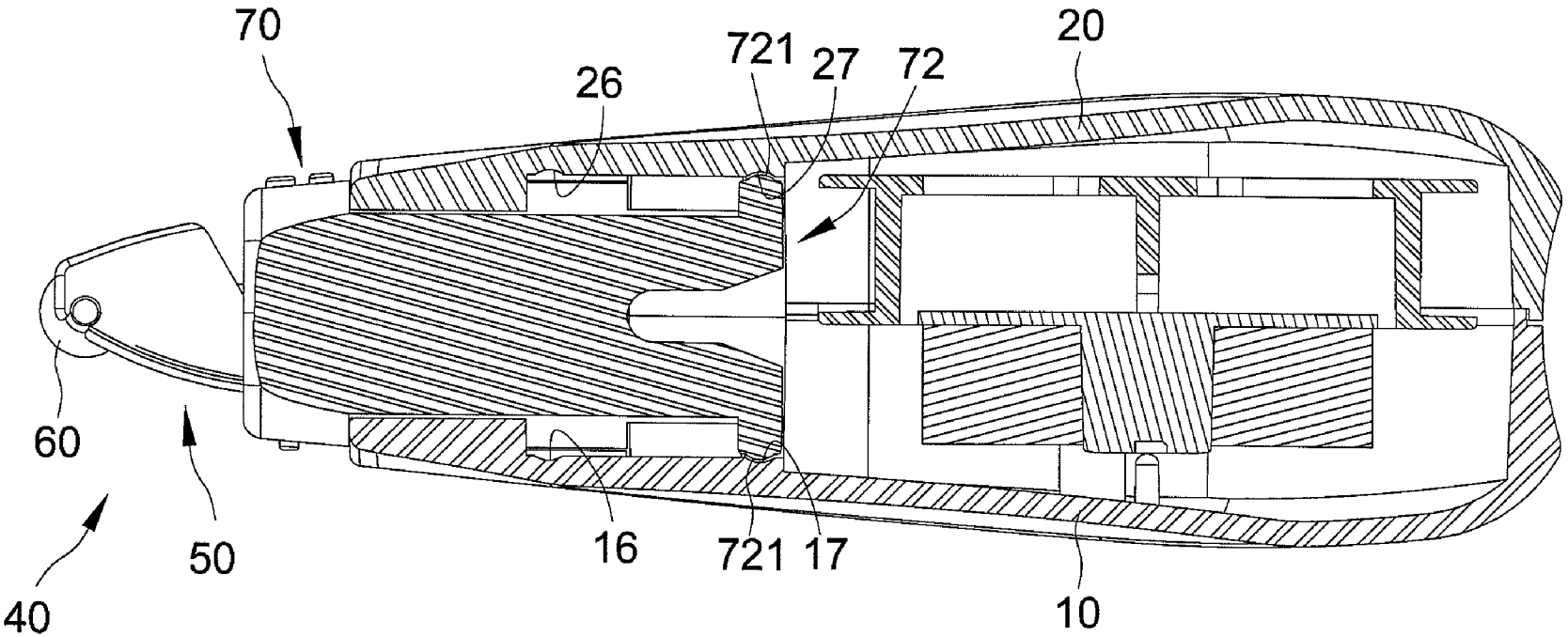
FIG. 6 is an extended cross-sectional view of FIG. 5 and in which the protection cap is at a position which allows exposure of an application head of the film transfer device.

FIGS. 4 through 6 show that the protection cap 70 is insertably mounted on the application head assembly 40. The protection cap 70 is moveable relative to the first and second cases 10 and 20. Specifically, the engaging sections 721 is adapted to be positioned on the first positioning sections 16 and 26 and on the second positioning sections 17 and 27 of the respective first and second cases 10 and 20. Thus the protection cap 70 is moveable between the two positions to selectively conceal the application head 60 or expose the application head 60. When the protection cap 70 is in a first position, the application head 60 is concealed by the protection cap 70, the clipping legs 72 engaged in the first and second cases 10 and 20 prevent the protection cap 70 disengaging from the first and second cases 10 and 20, and the engaging sections 721 are positioned on the first positioning sections 16 and 26. Furthermore, when the protection cap 70 is in a second position, the clipping legs 72 are engaged in the first and second cases 10 and 20, and the engaging sections 721 are positioned on the second positioning sections 17 and 27.

Figure 7:
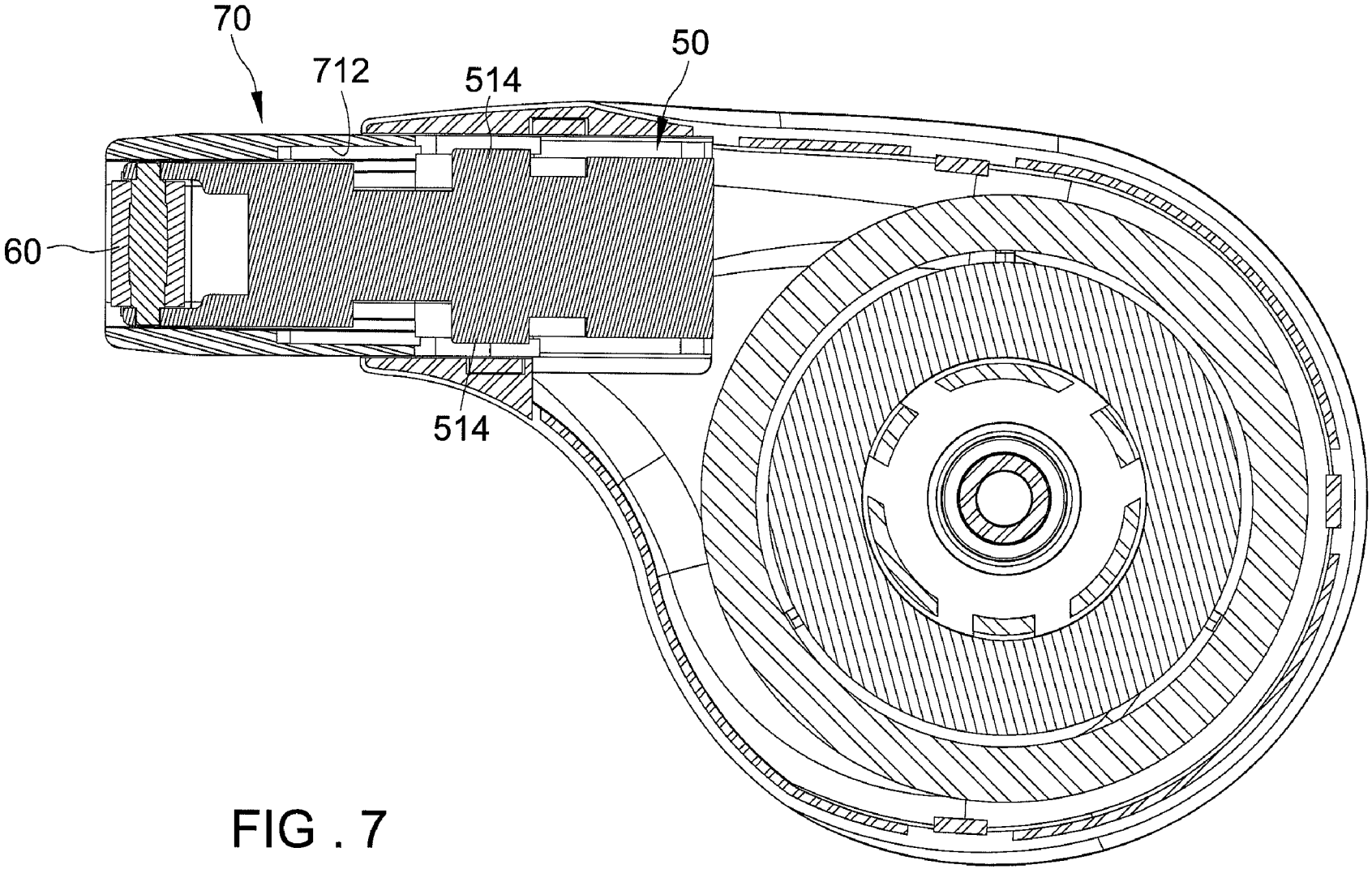
FIG. 7 is a cross-sectional view taken along line 7-7 of FIG. 1.
Figure 8:
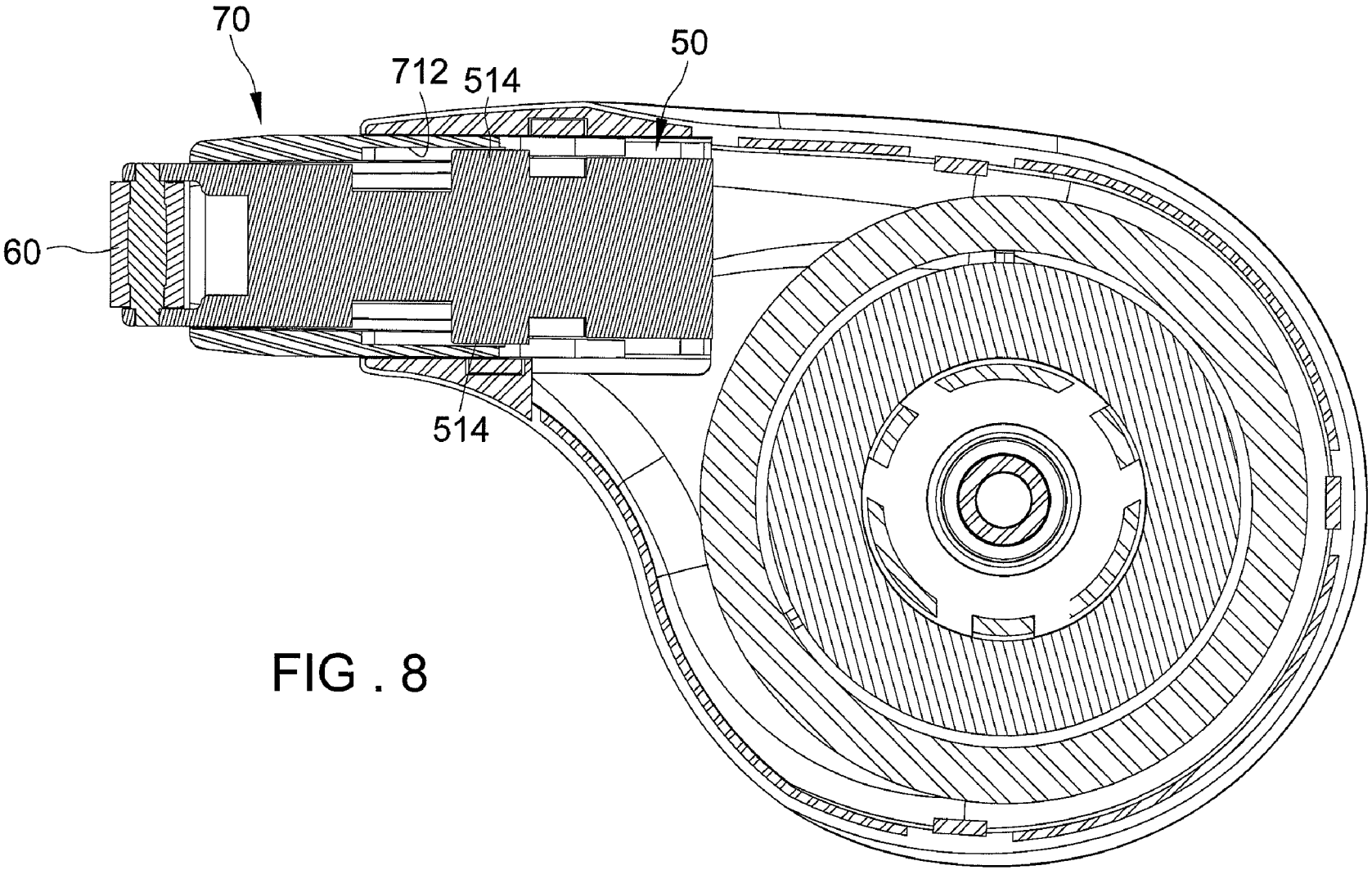
FIG. 8 is an extended cross-sectional view of FIG. 7 and shows a position of the protection cap.
Figure 9:
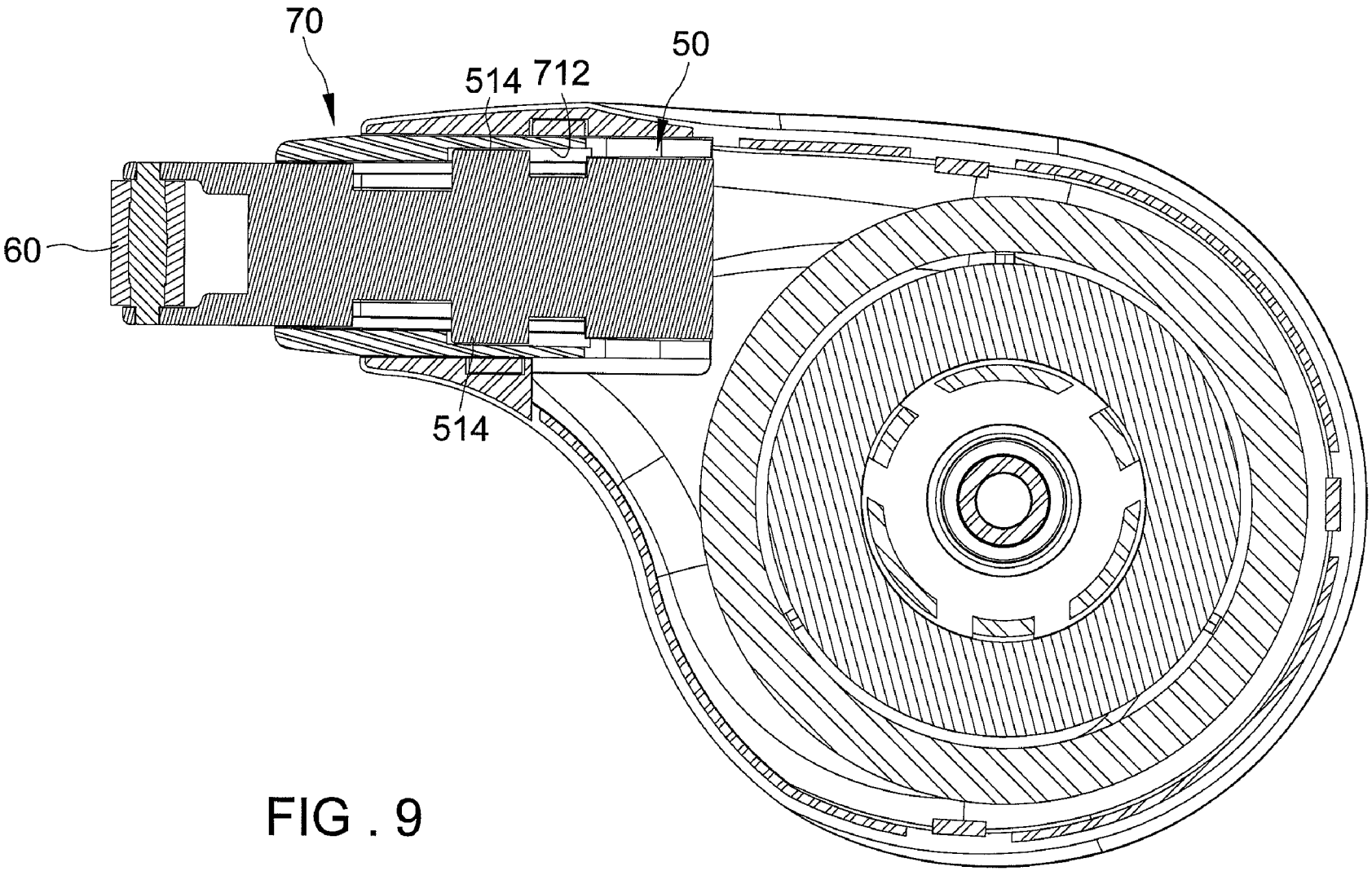
FIG. 9 is an extended cross-sectional view of FIG. 8 and in which the protection cap is at a position which allows exposure of an application head of the film transfer device.

FIGS. 7 through 9 show that the application head 60 concealed by the protection cap 70 when the protection cap is in the first position. Thus, the application head 60 is protected from dust or dirt. Furthermore, when the protection cap 70 is in the second position, the protection cap 70 exposes the application head 60, and the application head 60 is in the in-use position to transfer film. Additionally, the position-limiting grooves 712 of the protection cap 70 which engage with the protruding sections 514 prevent the protection cap 70 from shaking movement, which adversely influences film-dispensing operation.

Figure 10:
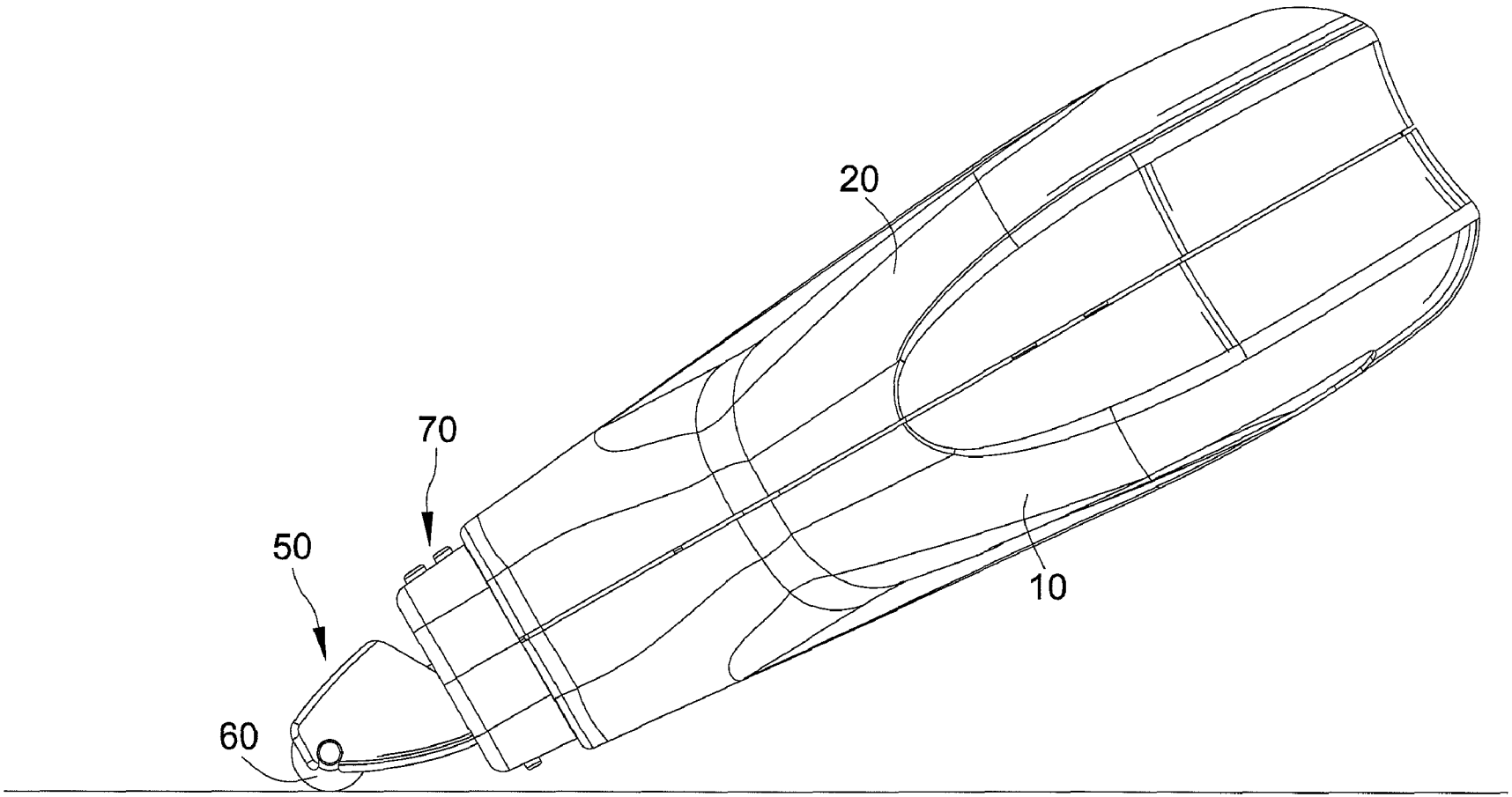
FIG. 10 shows the application head exposed and in use.

FIG. 10 shows that the protection cap 70 in the second position. In use of the application head 60, the protection cap 70 is moved to the second position. The application head 60 is thereafter positioned on a surface of an item to be worked with. Thus, the user can ensure that film is transferred on the surface.

Figure 11:
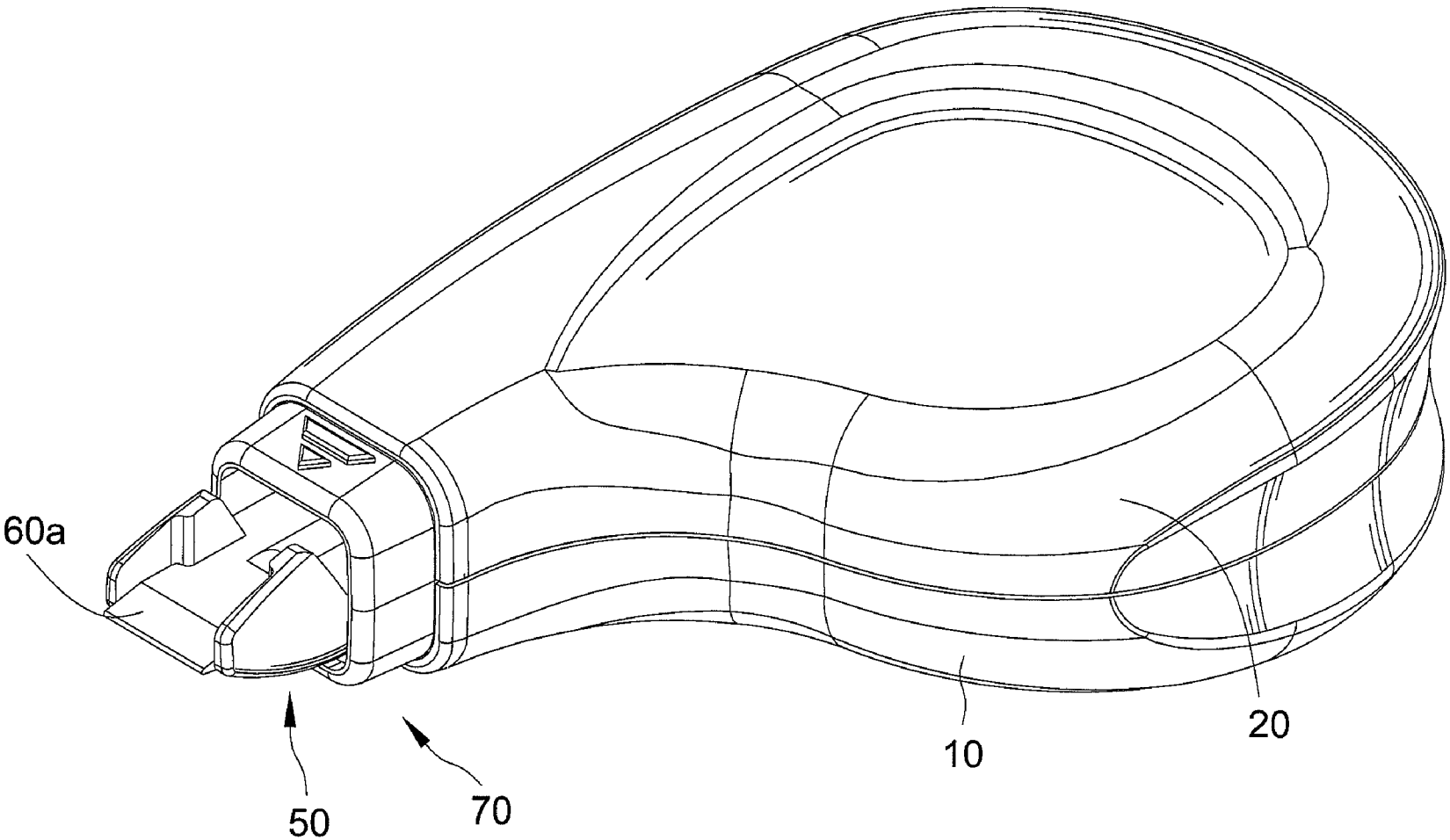
FIG. 11 is a perspective view of a film transfer device with a slidable cap in accordance with a second embodiment of the present invention.

FIG. 11 shows a perspective view of a film transfer device with a slidable protection cap 70 in accordance with a second embodiment of the present invention. The second embodiment is similar to the first embodiment except that it includes an application head 60a including a flat head. Likewise, the protection cap 70 is moveable between two positions, and the protection cap 70 conceals the application head 60a when in a first position, and the protection cap 70 exposes the application head 60a when in a second position. The protection cap 70 can also protect the application head 60a from dust or dirt.

In view of the foregoing, the film transfer device which has a slidable protection cap 70 of the present invention includes a case, i.e. a first case 10 and a second case 20, a reel mechanism 30, an application head assembly 40, and a protection cap 70. The application head assembly 40 is retained in receiving sections 18, 28 of the respective first and second cases 10 and 20. Additionally, the application head assembly 40 includes an application head 60, 60*a* exposed outside opening sections 15 and 25 of the respective first and second cases 10 and 20. The protection cap 70 is disposed between the first and second cases 10 and 20 and is moveable between two positions. The protection cap 70 conceals the application head 60*a* when in a first position, and the protection cap 70 exposes the application head 60*a* when in a second position. Thus, the application head 60 is in the in-use position to transfer film.

In view of the foregoing, the protection cap 70 is disposed between the first and second cases 10 and 20 and is moveable between two positions to selectively conceal or expose the application head 60, 60*a*. Thus, the application head 60, 60*a* is protected from dust and dirt by the protection cap 70.

Furthermore, the protection cap 70 exposes the application head 60 when the protection cap 70 is in the second position. Additionally, the position-limiting grooves 712 of the protection cap 70 which engage with the protruding sections 514 prevent the protection cap 70 from shaking movement, which adversely influences film-dispensing operation.

Moreover, the fixing frame 50 is retained between the first and second cases 10 and 20 and is prevented from displacement. Thus, the steadiness of the fixing frame 50 is ensured, and the fixing frame 50 is prevented from loosening and displacement in the first and second cases 10 and 20.

While the specific embodiments have been illustrated and described, numerous modifications come to mind without significantly departing from the spirit of invention and the scope of invention is only limited by the scope of accompanying claims.

What is claimed is:

1. A film transfer device with a slidable protection cap comprising:

a case including a compartment, a receiving section connected with the compartment, an opening section in proximity to the receiving section, and first and second positioning sections disposed in proximity to the receiving section;

a reel mechanism disposed in the compartment;

an application head assembly retained in the receiving section and including a fixing frame and an application head, with the fixing frame including a first end and a second end, with the first end of the fixing frame including a first guiding wall and a second guiding wall, with the first and second guiding walls disposed on an extremity of the fixing frame, with the first and second guiding walls guiding film from the reel mechanism through a rotation, and with the application head exposed outside the opening section; and a protection cap including a body and two clipping legs, with the two clipping legs abutting against the case, with the protection cap including an engaging section selectively positioned on the first positioning section and on the second positioning section, with the protection cap slidably mounted in the receiving section between a first position and a second position, with the application head concealed by the protection cap as the protection cap is in the first position, and with the application head exposed from the protection cap as the protection cap is in the second position, wherein each of the two clipping legs includes a through slot extended axially and enabling the clipping leg to have bending resiliency.

2. The film transfer device with the slidable protection cap as claimed in claim 1 wherein two engaging sections are extended from two opposite sides of the protection cap respectively and disposed on the two clipping legs respectively.

3. The film transfer device with the slidable protection cap as claimed in claim 1 wherein the first end is retained in the receiving section, and wherein the protection cap is insertably mounted on the fixing frame.

4. The film transfer device with the slidable protection cap as claimed in claim 1 wherein the first end is retained in the receiving section, and wherein the protection cap is insertably mounted on the fixing frame.

5. The film transfer device with the slidable protection cap as claimed in claim 1 wherein the application head is configured as a roller.

6. The film transfer device with the slidable protection cap as claimed in claim 1 wherein the application head includes a flat head.

7. The film transfer device with the slidable protection cap as claimed in claim 1 wherein the case includes a first case and a second case, with the first case disposed symmetrical to and connected with the second case.

8. A film transfer device with a slidable protection cap comprising:

a case including a compartment, a receiving section connected with the compartment, a first positioning section and a second positioning section disposed in proximity to the receiving section, and an opening section in proximity to the receiving section;

a reel mechanism disposed in the compartment;

an application head assembly retained in the receiving section and including an application head, with the application head exposed outside the opening section; and a protection cap slidably mounted in the receiving section between a first position and a second position and including an engaging section selectively positioned on the first positioning section and on the second positioning section, a body and two clipping legs abutting against the case, with the application head concealed by the protection cap as the protection cap is in the first position, and with the application head exposed from the protection cap as the protection cap is in the second position, wherein the application head assembly includes a fixing frame having a first end and a second end, with the first end retained in the receiving section, and with the second end connected with the application head, wherein the protection cap is insertably mounted on the fixing frame, wherein the first end of the fixing frame includes two lateral walls, wherein the receiving section includes a stopping section disposed corresponding to one of the two lateral walls, and wherein the two lateral walls are stopped on the respective stopping section.

9. The film transfer device with the slidable protection cap as claimed in claim 8 wherein the fixing frame includes two lateral sides and each lateral side includes a protruding section extended therefrom and disposed in proximity to one of the two lateral walls, wherein the protection cap includes two lateral surfaces and two position-limiting grooves extended thereon, and wherein the protruding sections are received in the position-limiting grooves respectively.

10. A film transfer device with a slidable protection cap comprising:

a case including a compartment, a receiving section connected with the compartment, an opening section in proximity to the receiving section, and first and second positioning sections disposed in proximity to the receiving section;

a reel mechanism disposed in the compartment;

an application head assembly retained in the receiving section and including a fixing frame and an application head, with the fixing frame including a first end and a second end, with the first end of the fixing frame including a first guiding wall and a second guiding wall, with the first and second guiding walls disposed on an extremity of the fixing frame, with the first and second guiding walls guiding film from the reel mechanism through a rotation, and with the application head exposed outside the opening section; and a protection cap including a body and two clipping legs, with the two clipping legs abutting against the case, with the protection cap including an engaging section selectively positioned on the first positioning section and on the second positioning section, with the protection cap slidably mounted in the receiving section between a first position and a second position, with the application head concealed by the protection cap as the protection cap is in the first position, and with the application head exposed from the protection cap as the protection cap is in the second position, wherein the first end is retained in the receiving section, wherein the protection cap is insertably mounted on the fixing frame, wherein the first end of the fixing frame includes two lateral walls, wherein the receiving section includes a stopping section disposed corresponding to one of the two lateral walls, and wherein the two lateral walls are stopped on the respective stopping section.

11. A film transfer device with a slidable protection cap comprising:

a case including a compartment, a receiving section connected with the compartment, a first positioning section and a second positioning section disposed in proximity to the receiving section, and an opening section in proximity to the receiving section;

a reel mechanism disposed in the compartment;

an application head assembly retained in the receiving section and including an application head, with the application head exposed outside the opening section; and a protection cap slidably mounted in the receiving section between a first position and a second position and including an engaging section selectively positioned on the first positioning section and on the second positioning section, a body and two clipping legs abutting against the case, with each of the two clipping legs including a through slot extended axially and enabling the clipping leg to have bending resiliency, with the application head concealed by the protection cap as the protection cap is in the first position, and with the application head exposed from the protection cap as the protection cap is in the second position.

12. A film transfer device with a slidable protection cap comprising:

a case including a compartment, a receiving section connected with the compartment, and an opening section in proximity to the receiving section, with the receiving section including a stopping section;

a reel mechanism disposed in the compartment;

an application head assembly retained in the receiving section and including an application head, a fixing frame having a first end retained in the receiving section and a second end connected with the application head, with the first end of the fixing frame including two lateral walls, with the stopping section disposed corresponding to one of the two lateral walls, with the two lateral walls stopped on the respective stopping section, and with the application head exposed outside the opening section; and a protection cap insertably mounted on the fixing frame and slidably mounted in the receiving section between a first position and a second position, with the application head concealed by the protection cap as the protection cap is in the first position, and with the application head exposed from the protection cap as the protection cap is in the second position.

13. The film transfer device with the slidable protection cap as claimed in claim 12 wherein the first end of the fixing frame includes a first guiding wall and a second guiding wall, with the first and second guiding walls disposed on an extremity of the fixing frame, and with the first and second guiding walls adapted to guide film from the reel mechanism through a rotation.

14. A film transfer device with a slidable protection cap comprising:

a case including a compartment, a receiving section connected with the compartment, an opening section in proximity to the receiving section, and first and second positioning sections disposed in proximity to the receiving section;

a reel mechanism disposed in the compartment;

an application head assembly retained in the receiving section and including a fixing frame and an application head, with the fixing frame including a first end and a second end, with the first end of the fixing frame including a first guiding wall and a second guiding wall, with the first and second guiding walls disposed on an extremity of the fixing frame, with the first and second guiding walls guiding film from the reel mechanism through a rotation, and with the application head exposed outside the opening section; and a protection a body and two clipping legs, with the two clipping legs abutting against the case, with the protection cap including an engaging section selectively positioned on the first positioning section and on the second positioning section, with the protection cap slidably mounted in the receiving section between a first position and a second position, with the application head concealed by the protection cap as the protection cap is in the first position and with the application head from the protection cap as the protection cap is in the second position, wherein the fixing frame defines a plane dividing the receiving section, with the first and second guiding walls defined on the first end of the fixing frame, with the second guiding wall opposite to the first guiding wall, with the second end of the fixing frame connected to the application head, with the first and second guiding walls disposed on an extremity of the fixing frame, with the first and second guiding walls extending in a direction substantially perpendicular to a direction from the first end to the second end, with the first guiding wall including a guiding edge extending generally perpendicular to the direction from the first end to the second end and to the plane, with the second guiding wall including a guiding edge extending at an angle which is not perpendicular or parallel to the direction from the first end to the second end and to the plane to guide film from the reel mechanism through a substantially 90° degree angle.

* * * * *